US005942736A

United States Patent [19]

Cortonesi

[11] Patent Number: 5,942,736

[45] Date of Patent: Aug. 24, 1999

[54] ANTINOISE BARRIER WITH TRANSPARENT PANELS, PROVIDED WITH ACOUSTIC INSULATION AND ACOUSTIC ABSORPTION CHARACTERISTICS

[75] Inventor: Rivo Cortonesi, Gravesano, Switzerland

[73] Assignees: Dieselbox SA, Gravesano, Switzerland; Vismara Attilio s.r.l., Dugnano, Italy

[21] Appl. No.: 09/109,185

[22] Filed: Jul. 2, 1998

[30] Foreign Application Priority Data

Jul. 9, 1997 [IT] Italy ..... MI9701630

[51] Int. Cl.[6] ..... E04B 9/00

[52] U.S. Cl. ..... 181/289; 181/286; 181/210

[58] Field of Search ..... 181/284, 286, 181/289, 292, 293, 294, 210; 428/34.4; 52/144

[56] References Cited

U.S. PATENT DOCUMENTS

| | | | |
|---|---|---|---|
| 2,966,954 | 1/1961 | Sabine | 181/289 |
| 3,460,299 | 8/1969 | Wilson | 181/289 |
| 4,194,334 | 3/1980 | Katona | 52/204.595 |
| 4,214,411 | 7/1980 | Pickett . | |
| 4,787,296 | 11/1988 | Huang | 181/289 |
| 5,532,440 | 7/1996 | Fujiwara | 181/289 |
| 5,700,527 | 12/1997 | Fuchs et al. | 428/34.4 |

FOREIGN PATENT DOCUMENTS

| | | |
|---|---|---|
| 19523544 | 1/1996 | Germany . |
| 590366 | 8/1977 | Switzerland . |

OTHER PUBLICATIONS

Patent Abstracts of Japan, vol. 98, No. 2, Jan. 30, 1998, JP 09 268524 A, (Yamazaki Sansho KK), Oct. 14, 1997.

Patent Abstracts of Japan, vol. 96, No. 3, Mar. 29, 1996, JP 07 300823 A, (Kazuo Takatsu; Others), Nov. 14, 1995.

Patent Abstracts of Japan, vol. 95, No. 9, Oct. 31, 1995, JP 07 144313 A, (Nozawa Corp.), Jun. 6, 1995.

Patent Abstracts of Japan, vol. 16, No. 523, Oct. 27, 1992, JP 04 1942056 A, (Asuku: KK), Jul. 14, 1992.

*Primary Examiner*—Khanh Dang

*Attorney, Agent, or Firm*—Jacobson, Price, Holman & Stern, PLLC

[57] ABSTRACT

Antinoise barrier including a perforated transparent panel fixed parallel to another solid transparent panel in such a way as to form an air interspace between the panels, with the perforated panel provided with holes having different dimensions.

5 Claims, 2 Drawing Sheets

ANTINOISE BARRIER WITH TRANSPARENT PANELS, PROVIDED WITH ACOUSTIC INSULATION AND ACOUSTIC ABSORPTION CHARACTERISTICS

FIELD OF THE INVENTION

The present invention concerns an antinoise barrier with transparent panels, provided with acoustic insulation and acoustic absorption characteristics.

BACKGROUND OF THE INVENTION

The antinoise barriers formed by panels that are located along roadway or railway communications to give acoustic protection to adjacent buildings are known.

Some kinds of opaque antinoise barriers comprise metal panels having one face, directed toward the noise source, made of perforated plate and housing materials with high acoustic absorbent characteristics, in particular mineral wool or glass wool. Indeed, it is known that sound energy, when incident on an acoustic absorbent surface, is absorbed in higher degree the higher is the coefficient of absorption of the material. In practice, the sound energy incident on these acoustic absorbent materials is transformed into heat because of the friction that is generated by the movement of the particles present in the interstices of the acoustic absorbent material hit by that energy.

Another type of barrier comprises instead transparent panels, in particular of glass, plexiglas, polymethyl methacrylate etc., which have acoustic insulation characteristics.

The inconvenience with the opaque barriers consists in compromising the luminosity of the buildings adjacent to the communication roads and in not allowing the view of the surrounding landscape.

The inconvenience with the barriers made of transparent panels consists in that, although offering sufficient acoustic insulation characteristics, they do not provide the absorption of sound waves. This can lead to an effect of acoustic reverberation toward the same noise source, which can have negative effects on the acoustic conditions of the zones contiguous to the transit roads and therefore limit the effectiveness of the barrier.

SUMMARY OF THE INVENTION

Object of the present invention is to realise an antinoise barrier with transparent panels, that would allow the absorption of sound waves, without compromising the luminosity and the view of the buildings lying next to said barriers.

According to the invention, such object is attained with an antinoise barrier characterised in that it comprises a perforated transparent panel fixed parallel to another solid transparent panel in such a way so as to form an air interspace between said panels.

In substance, the antinoise barrier according to the invention takes advantage of the typical resonance concept of the known Helmholtz acoustic resonator, by which sound energy within a cavity, in this case corresponding to the air cylinder created between two panels, at each hole of the perforated plate, undergoes a dissipation at the frequency of resonance of the same cavity.

Said perforated plate is advantageously provided with holes having different dimensions that allow to achieve the absorption at various frequencies of the incoming sound wave.

BRIEF DESCRIPTION OF THE DRAWINGS

A possible embodiment is illustrated as a non-limiting example in the enclosed drawings, in which.

DETAILED DESCRIPTION OF THE PREFERRED EMBODIMENTS

Figure 2:
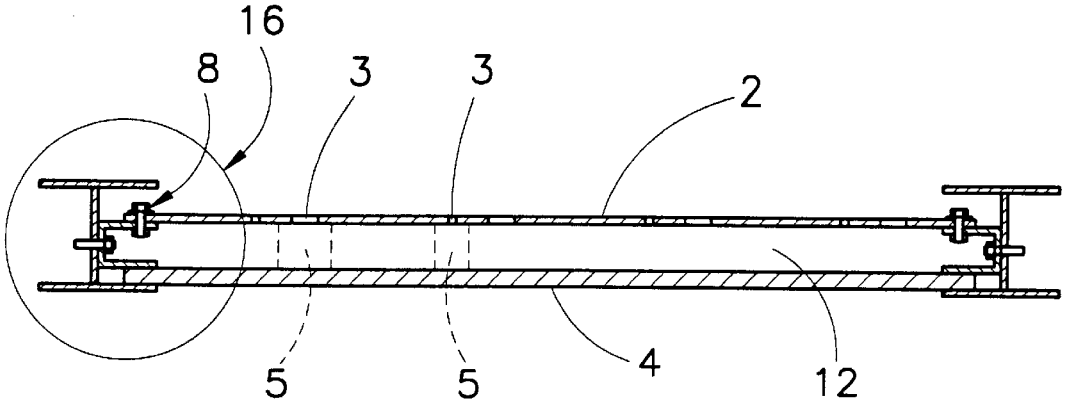
FIG. 2 is a sectional view of the barrier according to line II—II of FIG. 1.
Figure 1:
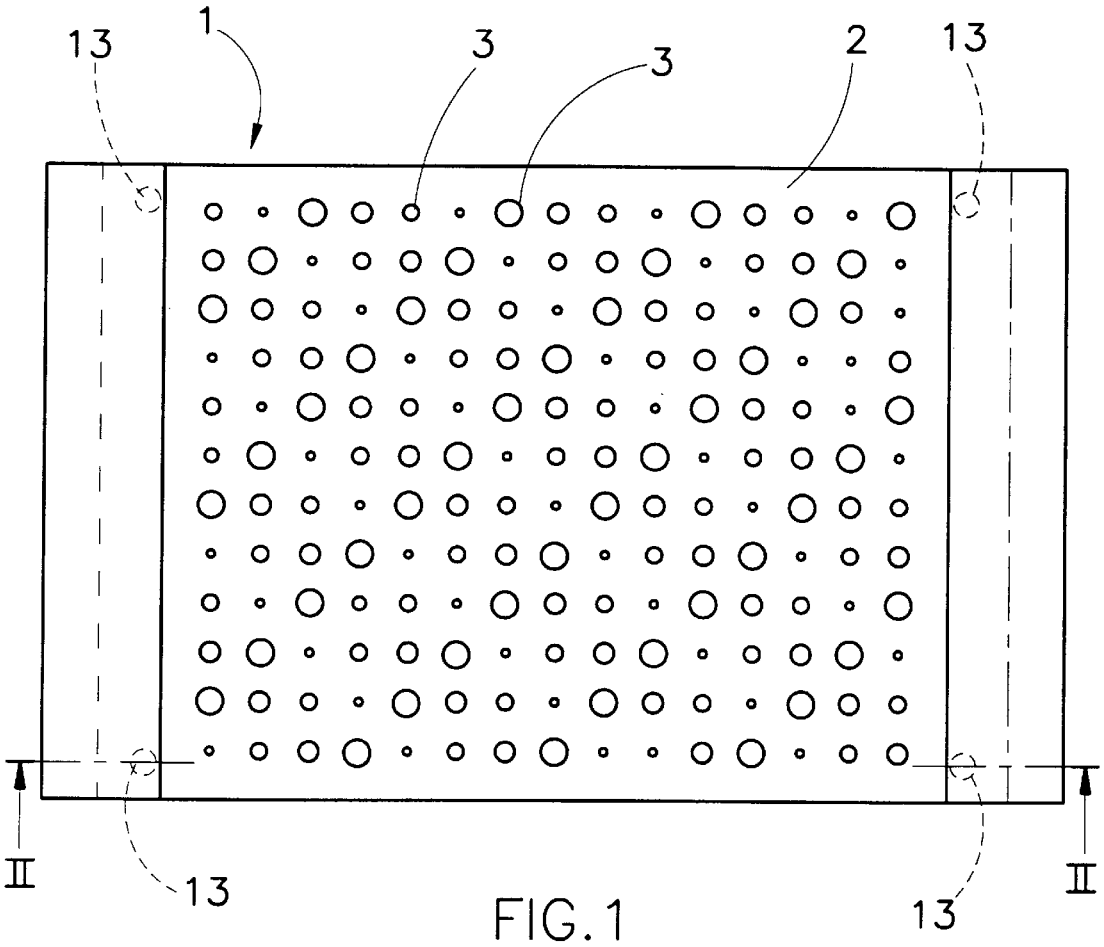
FIG. 1 is a front view of a barrier with transparent panels according to the invention.

With reference to FIGS. 1 and 2, a barrier 1 according to the invention comprises two transparent panels coupled to each other: a first transparent panel 2 is provided with a series of holes 3 having different diameters opportunely arranged along the surface of the panel and a second panel 4, still transparent but without holes, is fixed parallel to the first panel 2 by means of spacing elements 16 in such a way that an interspace 12 is created between the two panels.

By facing the perforated panel 2 toward the source of sound, each hole 3 and the respective air cylinder 5 formed inside the interspace 12 starting from the hole 3 operates as a Helmholtz acoustic resonator.

Figure 4:
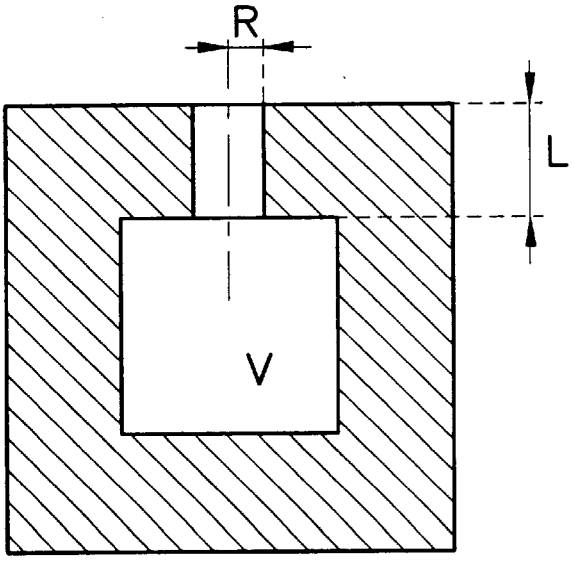
FIG. 4 shows a Helmholtz acoustic resonator.

As shown in FIG. 4, Helmholtz acoustic resonators consist in a rigid casing with a volume V having a small hole with radius R and length L.

These resonators are used to eliminate unwanted frequencies. The sound energy entering the resonator is dissipated as a consequence of the friction generated in the neck of the resonator due to the oscillation of air inside the cavity of the same resonator as caused by the incident sound wave. In conditions of resonance such oscillations get to a maximum and maximum is the sound energy being dissipated at a certain frequency, that is called resonance frequency.

Still with reference to FIG. 4, the resonance frequency $f_r$, at which the phenomenon of dissipation of the incident sound wave occurs, depends on the geometry of the resonator:

$$f_r = \frac{c}{2\pi}\sqrt{\frac{\pi R^2}{V(L+\pi R/2)}}$$

where c is the velocity of propagation of sound.

It results that, with equal geometrical parameters, each resonator attenuates only one frequency at a time.

For this reason the panel 2 is provided with a series of holes with different diameters which are dimensioned and positioned on the bases of the sound spectrum of the source of noise that it is meant to attenuate.

The friction that is generated during the oscillation of the entire perforated panel that, as a consequence of the incident sound wave, resonates on a typical resonance frequency also contributes to the attenuation of the noise produced by that frequency, which depends on the specific mass (M) of the vibrating panel and on the thickness of the air interspace (d=distance between panels) according to the formula $$f_r = 600\sqrt{\frac{1}{Md}}$$

In particular, the design elements that are utilised are: the specific mass of the perforated panel 2, that depends both on the type of material it is made of and on its thickness; the distance between the perforated panel 2 and the solid one 4; the specific mass of the solid panel 4, that depends both on the type of material it is made of and on its thickness; the diameter and the interaxes between the holes 3 which the perforated panel 2 is provided with, the number of holes with equal diameter and their arrangement.

In particular, in FIG. 1 a panel 2 provided with holes having four different dimensions is shown.

The spacing elements 16, that connect the perforated panel 2 to the solid one 4, can be bars that engage in pre-set holes 13 in the panels 2, 4 by means of fixing elements 8.

Figure 3:
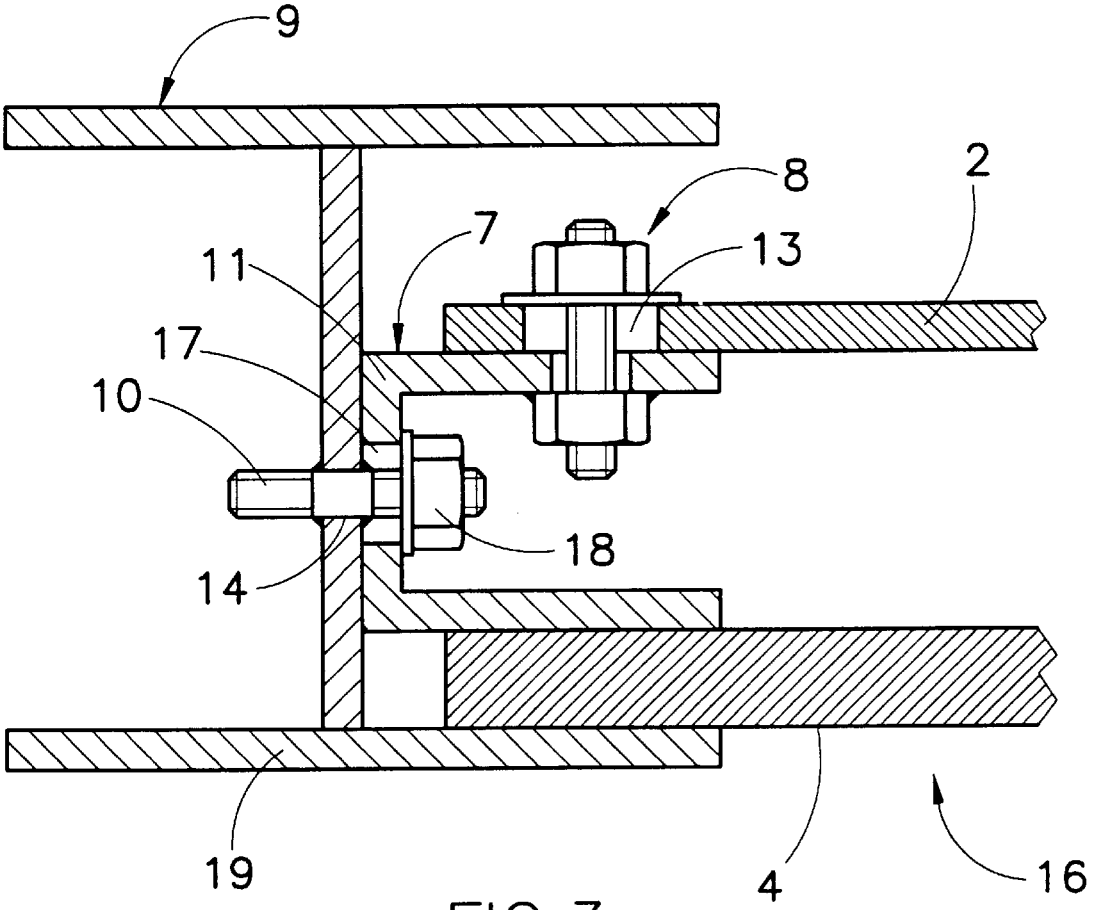
FIG. 3 is a magnified sectional view of the spacing elements provided between the two transparent panels of the barrier of FIG. 1.

In an embodiment shown in FIG. 3, in order to allow longitudinal and transverse thermal expansions between the panels 2, 4 when they are connected to each other, these spacing elements 16 comprise a U-beam 7 and a double T-beam 9 provided with holes 14, in which screws 10 passing through holes 17 of an internal rib 11 of the U-beam 7 are welded.

During the assembly stage, the panel 4 is placed against a flange 19 of the double T-beam 9 and subsequently the U-beam 7 is inserted, with the hole 17 fit on the screw 10, and fixed to the latter by means of the nut 18 in such a way that the panel 4 gets to be comprised between the flange of the double T-beam 9 and the U-beam 7.

The perforated panel 2 is subsequently fixed to the U-beam 7 by screw means 8, through the holes 13.

The expansions of the solid panel 4 are then possible since this rests on the beam 9, while the ones of the perforated panel 2 are guaranteed by the clearance existing between the holes 13 and the screw means 8.

In addition, since the two panels 2, 4 are coupled to each other by means of spacing elements, the free flow of air and rain water and of the water to wash the same barrier is easily allowed.

As an alternative to the assembly of FIG. 3, it is possible to provide for the substitution of the U-beam 7 by means of a 90° bending of the edge of the perforated panel 2, that is set against the solid panel 4. In this case appropriate pressure screws can be employed that, acting between the perforated panel 2 and the internal surface of the adjacent horizontal flange of the beam 9, maintain the perforated panel 2 pressed against the solid panel 4 and the latter against the opposite horizontal flange of the beam 9. Similar pressure screws can be provided between the terminal bendings of the perforated panel 2 and the vertical shaft of the beam 9.

The antinoise barrier according to the invention can be mounted either vertically or horizontally, and also in curved bearing structures by taking advantage of their flexibility.

In addition the transparent material used for these panels ranks among the ones offering the best fire-proof, antismoke and antitoxic guarantees.

The diffraction of light through the holes in the panel when directed toward the source allows birds to individuate the transparent obstacle both on the side of the perforated panel 2 and on the one of the solid panel, in full respect of the environment.

I claim:

1. Antinoise barrier comprising a perforated transparent panel having a plurality of holes; and a solid transparent panel fixed to and extending parallel to said perforated transparent panel to form an air interspace between said perforated transparent panel and said solid transparent panel, said air interspace being used as an acoustic resonating cavity for sound entering said air interspace through said plurality of holes to dissipate the sounds.

2. Antinoise barrier according to claim 1, wherein said holes have different dimensions.

3. Antinoise barrier according to claim 1, wherein said perforated transparent panel and said solid transparent panel are maintained at a distance from each other by spacing elements including a U-beam and a double T-beam coupled to each other.

4. Antinoise barrier according to claim 3, wherein said U-beam and said double T-beam are coupled to each other by screws.

5. Antinoise barrier according to claim 1, wherein one of said panels has at least one 90° bend on one edge that is placed against a surface of the other of said panels, pressure screws being interposed between the surface of said panel provided with said at least one bend and a parallel flange of a double T-beam to press said panel provided with said at least one bend against said other panel.

* * * * *

UNITED STATES PATENT AND TRADEMARK OFFICE

CERTIFICATE OF CORRECTION

PATENT NO. : 5,942,736

DATED : August 24, 1999

INVENTOR(S) : Rivo CORTONESI

It is certified that error appears in the above-identified patent and that said Letters Patent is hereby corrected as shown below:

On the title page, item

[73] Assignees: Dieselbox SA, Gravesano, Switzerland;
Vismara Attilio s.r.l., Paderno Dugnano (MI), Italy Signed and Sealed this Eighteenth Day of January, 2000

*Attest:*

*Attesting Officer*

Q. TODD DICKINSON

*Commissioner of Patents and Trademarks*